United States Patent [19]

Watahiki et al.

[11] Patent Number: 4,877,344

[45] Date of Patent: Oct. 31, 1989

[54] IMPACT PRINTER TEMPERATURE CONTROL DEVICE

[75] Inventors: Shinichi Watahiki; Nobuhiko Itoh; Nobuo Ihata; Masao Miyasaka, all of Ibaraki, Japan

[73] Assignee: Hitachi Koki Company, Limited, Tokyo, Japan

[21] Appl. No.: 182,679

[22] Filed: Apr. 18, 1988

[30] Foreign Application Priority Data

Apr. 17, 1987 [JP] Japan ..... 62-95794

[51] Int. Cl.[4] ..... B41J 3/12

[52] U.S. Cl. ..... 400/124; 400/54; 400/719

[58] Field of Search ..... 400/54, 124, 719

[56] References Cited

U.S. PATENT DOCUMENTS 4,540,295 9/1985 Okunishi et al. ..... 400/719
4,664,542 5/1987 Tsugita ..... 400/719

FOREIGN PATENT DOCUMENTS 117668 9/1981 Japan ..... 400/124 TC
38070 3/1984 Japan ..... 400/124 TC
48389 3/1985 Japan ..... 400/124 TC
29559 2/1986 Japan ..... 400/54
217273 9/1986 Japan ..... 400/719
249774 11/1986 Japan ..... 400/719

*Primary Examiner*—David A. Wiecking
*Attorney, Agent, or Firm*—Sughrue, Mion, Zinn, Macpeak & Seas

[57] ABSTRACT

In a control device for an impact printer for performing a printing operation at a first printing speed, a temperature sensing element, provided such that the temperature of an electromagnet unit can be directly or indirectly detected, is operated at a first temperature and restored at a second temperature lower than the first temperature. A controller changes the printing speed to a second printing speed lower than the first printing speed when the temperature sensing element is operated, returns the printing speed to the first printing speed when the element is restored, and changes the operating speed to a third printing speed lower than the second printing speed when the element is operated for a predetermined period of time, whereby the printer is made high in reliability.

10 Claims, 6 Drawing Sheets

IMPACT PRINTER TEMPERATURE CONTROL DEVICE

BACKGROUND OF THE INVENTION

1. Technical Field

This invention relates to impact printers, and more particularly to a control device for an impact printer in which the temperature of an electromagnet unit is directly or indirectly detected to control the printing speed.

2. Prior Art

Low-speed or middle-speed impact printers have been improved to provide low noise, small size, and low manufacturing. In addition, they have been enclosed in a compact housing.

The printing speeds of these impact printers are not high; however, the printers can print more than 1,000 lines per minute, and therefore they should be regarded as heavy duty printers.

Under heavy duty conditions, a large quantiy of heat is generated by the electromagnet unit in which a number of electromagnets are provided with high concentration, and a part of the heat thus generated is stored in the unit. As a result, the temperature of the electromagnet unit may be greatly increased (over the allowable temperature of the electromagnet unit). Therefore, the electrical and mechanical characteristics of the printing hammers are changed, and especially the change of the flight time may result in a difficulty that the resultant print is low in quality; e.g., characters are missing. The flight time is defined as the time elapsed from the generation of a printing order until the start of an actual typing operation due to the printing hammers. In the case of a dot printer, the flight time is the time elapsed until the printing hammer presses a sheet to a platen.

This difficulty may be eliminated by developing high-temperature resisting printing hammers. However, under the present technical conditions the development of such printing hammers is limited. Therefore, one solution is to employ a high-efficiency cooling mechanism to decrease the temperature of the electromagnet unit. However, the use of the cooling mechanism suffers from the following difficulties: the addition of the cooling mechanism requires the use of expensive components such as a blower and a cooling duct, and many other parts must be provided for the installation of these components. As a result, the printer is unavoidably high in manufacturing cost, it may be rather difficult to miniaturize the printer, and sometimes it is necessary to change the housing.

On the other hand, an impact printer is generally operated with a 50% printing duty per page or less. That is, the impact printer is not often used with a 100% printing duty per page nor it is used continuously for a long period. Therefore, it is not economical to design an impact printer whose standard printing mode is a 100% continuous printing mode.

SUMMARY OF THE INVENTION

Accordingly, an object of this invention is to eliminate the above-described difficulties accompanying a conventional impact printer.

More specifically, an object of the invention is to provide a control device for an impact printer which does not affect the size and manufacturing cost of the impact printer and, which prevents the quality of print from being lowered by the change of flight time which is caused by the heavy duty conditions.

The foregoing object and other objects of the invention have been achieved by the provision of a control device for an impact printer in which a plurality of electromagnetic printing hammers are arranged in the direction of line. A printing operation is carried out at a first printing speed $L_1$ which is predetermined with a prining cycle and a sheet-feeding cycle conducted repeatedly. The device, according to the invention, comprises: a temperature sensing element provided so that the temperature of an electromagnet unit can be directly or indirectly detected, the temperature sensing element having a hysteresis such that the temperature sensing element is operated at a first predetermined temperature and is restored at a second predetermined temperature lower than the first predetermined temperature; and a controller which limits the printing speed to a second printing speed $L_2$ lower than the first printing speed in response to a signal provided when the temperature sensing element is operated, and which returns the printing speed to the first printing speed $L_1$ which the temperature sensing element is restored, and which limits the printing speed to a third printing speed $L_3$ lower than the second printing speed $L_2$ when the temperature sensing element is maintained for a first predetermined period of time.

The nature, principle and utility of the invention will become more apparent from the following detailed description and the appended claims when read in conjunction with the accompanying drawings.

DETAILED DESCRIPTION OF THE PREFERRED EMBODIMENTS

Figure 4:
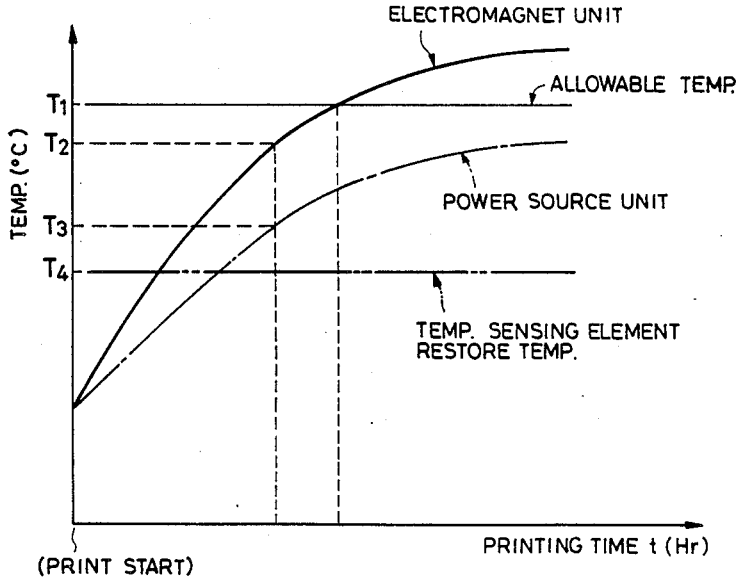
FIG. 4 is a graphical representation indicating temperature rise with printing time for the operation of one example of a conventional printer.

More specifically, FIG. 4 is a characteristic diagram showing the variations in temperature with printing time of an electromagnet unit and of a power source unit for supplying drive power to the electromagnet in an ordinary printing operation. As is apparent from FIG. 4, the temperatures of the electromagnet unit and the power source unit are increased substantially in the same rate after the initial printing period. Therefore, the above-described temperature sensing element may be provided at the electromagnetic unit to directly detect the temperature of the electromagnet unit, or it may be provided for instance at the heat radiating fins of a final stage power transistor forming a switching regulator in the power source unit to indirectly detect it.

The invention will be described with reference to the case where the temperature sensing element is provided in the power source unit.

In order to prevent the temperature of the electromagnet unit from exceeding an allowable temperature $T_1$ (FIG. 4), the maximum temperature of the electromagnet unit is set to a value $T_2$ lower than the allowable temperature $T_1$ with a marginal temperature taken into account. When the temperature of the electromagnet unit reaches the value $T_2$, the temperature of the power source unit is at $T_3$. Therefore, the temperature sensing element employed is operated at the temperature $T_3$ and restored at a temperature $T_4$.

Figure 5:
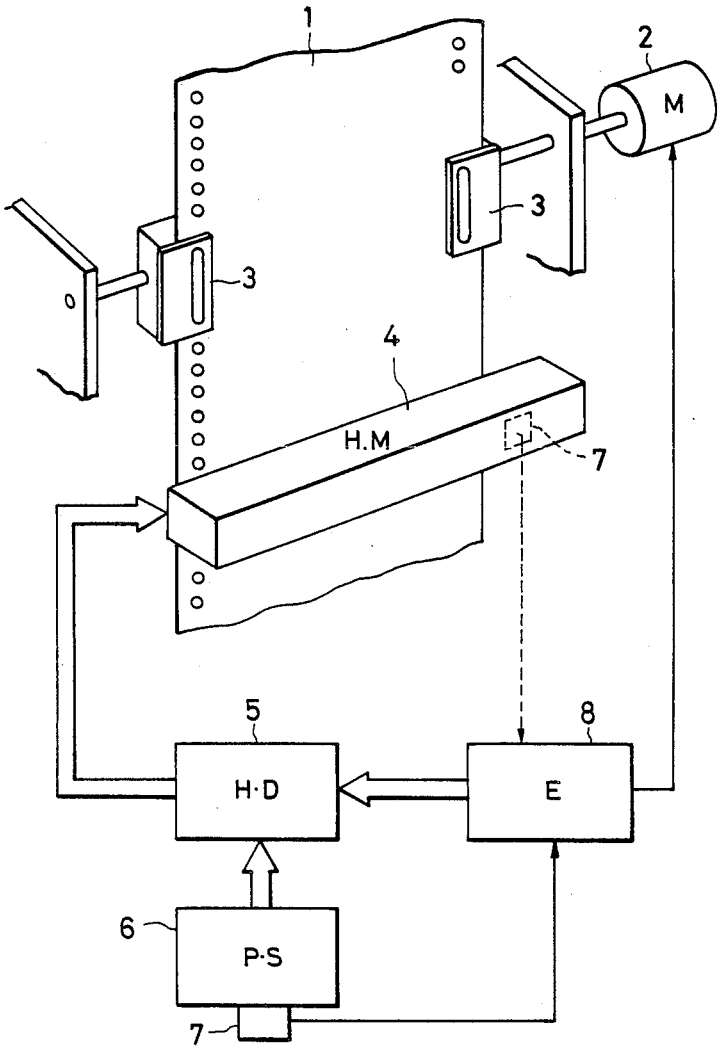
FIG. 5 is a block diagram showing the arrangement of the impact printer control device according to the invention.

In one example of an impact printer control device of the invention, as shown in FIG. 5, a printing sheet 1 is intermittently conveyed by a tractor 3 which is operated, for instance, by a step motor 2. Electromagnet-operated printing hammers 4 are arranged in the widthwise direction of the sheet 1 and are driven by a driver 5 comprising, for instance, power transistors. Driving electric power is supplied to the driver 5 by a power source unit 6. As was described above, the temperature sensing element 7 is disposed in an electromagnet unit provided for the printing hammers 4, or in the power source unit 6. The output signal of the temperature sensing element 7 is applied to a controller 8. The controller 8 comprises, for instance, a microprocessor to control the operations of the driver 5 and the step motor 2.

Figure 1:
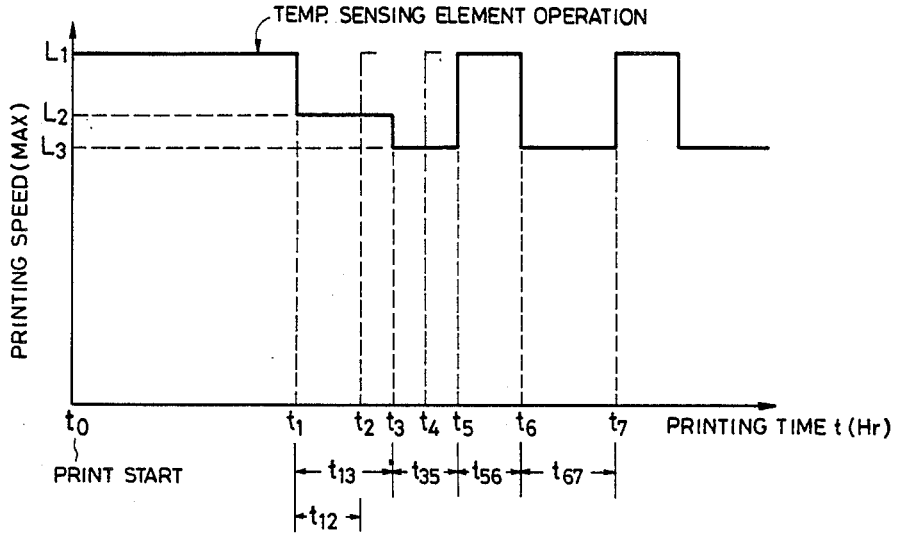
FIG. 1 is a graphical representation indicating printing speed with printing time for the operation of one example of an impact printer control device according to this invention.
Figure 2:
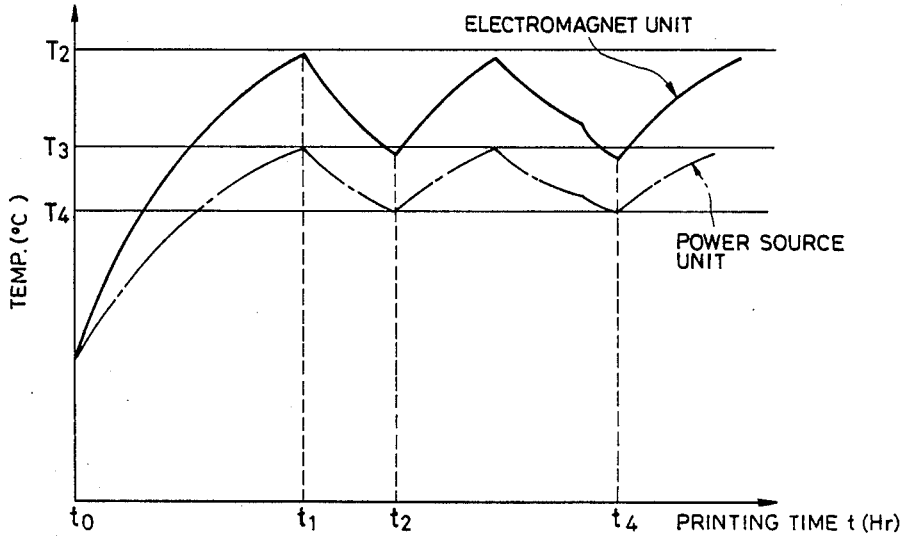
FIG. 2 is a graphical representation indicating temperature rise with printing time for the operation of the impact printer control device at room temperature.

The operation of the impact printer control device thus organized will be described with reference to FIG. 1.

It is assumed that a printing operation is started at the time instant $t_0$. At the time instant $t_0$, the temperature sensing element 7 is not operated, and therefore the printing operation is carried out at the maximum printing speed $L_1$ (lines/minutes).

As the printing operation is continued at the printing speed $L_1$, the temperature of the electromagnet unit is increased. It is assumed that at the time instant $t_1$ the temperature sensing element 7 is operated to provide an output signal responsive to the temperature T3. In response to the output signal, the controller 8 limits the printing speed of $L_2$ ($<L_1$). Thereafter, the controller 8 detects whether or not the temperature sensing element 7 is restored. Upon reception of a signal indicating the restoration of the temperature sensing element 7 (at the time instant $t_2$), the controller 8 returns the printing speed of $L_1$ as indicated by the one-dot chain line in FIG. 1.

When the temperature sensing element 7 is not restored even a predetermined period of time $t_{13}$ ($=t_3-t_1$) after the limitation of the printing speed to $L_2$, the controller 8 further decreases the printing speed to $L_3$ ($<L_2$), and detects whether or not the temperature sensing element 7 is restored. Upon reception of a signal indicating the restoration of the temperature sensing element 7 (at the time instant $t_4$) the controller 8 returns the printing speed to $L_1$ as indicated by the two-dot chain line in FIG. 1. The above-described predetermined period of time $t_{13}$ is determined by adding a marginal period of time to the period of time which is required for the temperature of the power source unit 6 to become lower than the restoration temperature of the temperature sensing element 7, when a printing operation with the printing speed $L_2$ is continued at a room temperature of about 20° C.

As described above, when the printer is operated at room temperature, the printing speed is limited to $L_2$ in response to the operation of the temperature sensing element 7, and in the case when the temperature sensing element 7 is not restored even through the printing operation has been carried out at the printing speed $L_2$ for the predetermined period of time $t_{13}$, the printing speed is further limited to $L_3$. As a result, the temperature of the electromagnet unit can be maintained lower than the predetermined value, and therefore the resultant print is satisfactory in quality.

In the case where the printer is used at an ambient temperature of about 30° C. higher than the room temperature, sometimes the temperature of the power source unit 6 is not decreased and the temperature sensing element 7 is therefore not restored although a predetermined period of time $t_{35}$ has passed after the time instant $t_3$ at which the printing speed is set to $L_3$. In this case, the printer operates at the printing speed $L_3$ throughout the continuous printing operation period.

Therefore, if the temperatures sensing element 7 is not restored when the printing operation is carried out at the printing speed $L_3$ for the predetermined period of time $t_{35}$, a first cycle in which the printing operation is performed at the printing speed $L_1$ for a predetermined period of time $t_{56}$ and a second cycle in which the printing operation is performed at the printing speed $L_3$ for a predetermined period of time $t_{67}$ are alternately carried out by means of the controller 8. The predetermined period of time $t_{35}$ is obtained by adding a marginal period of time to a period of time which is required for the temperature of the power source unit 6 unit to become lower than the restoration temperature of the temperature sensing element 7 when the printing operation is continued at the printing speed $L_3$ at an ambient temperature of about 30° C. higher than the room temperature. The above-described predetermined period of time $t_{56}$ is set to a value with which, when the printing operation is continued at the printing speed $L_1$, assures that the temperature of the electromagnet unit will not exceed the temperature $T_2$. The above-described predetermined period of time $t_{67}$ is set to a value with which, when the printing operation is continued at the printing speed $L_3$, assures that the temperature of the electromagnet unit is sufficiently greatly decreased.

Figure 3:
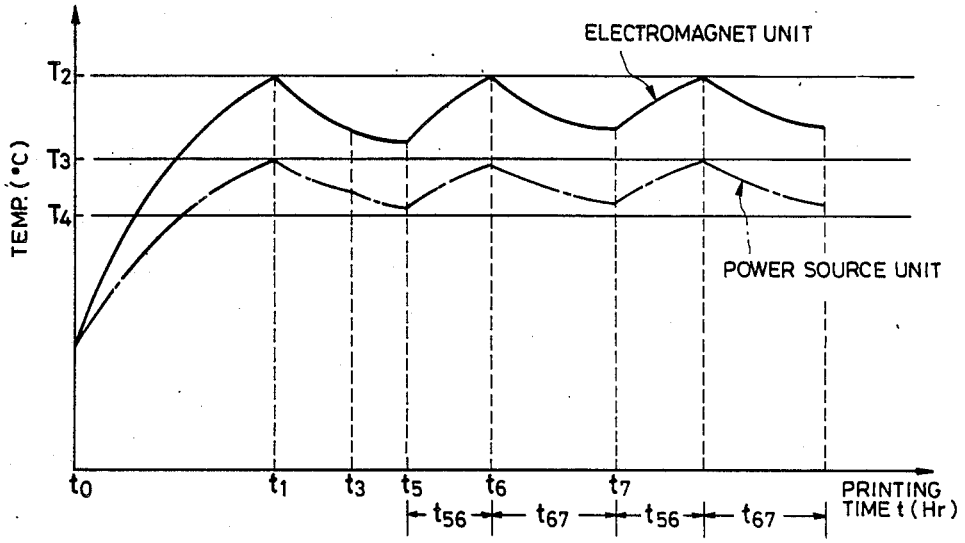
FIG. 3 is also a graphical representation indicating temperature rise with printing time for the impact printer control device whose temperature is higher than room temperature.

Therefore, in the case where the printer is operated at an ambient temperature higher than room temperature, as shown in FIG. 3, the temperature of the electromagnet unit can be maintained lower than the predetermined value, and the resultant print is satisfactory in quality. Furthermore, the printer can be operated with high efficiency, and it is unnecessary to greatly decrease the effective printing speed.

Figure 6:
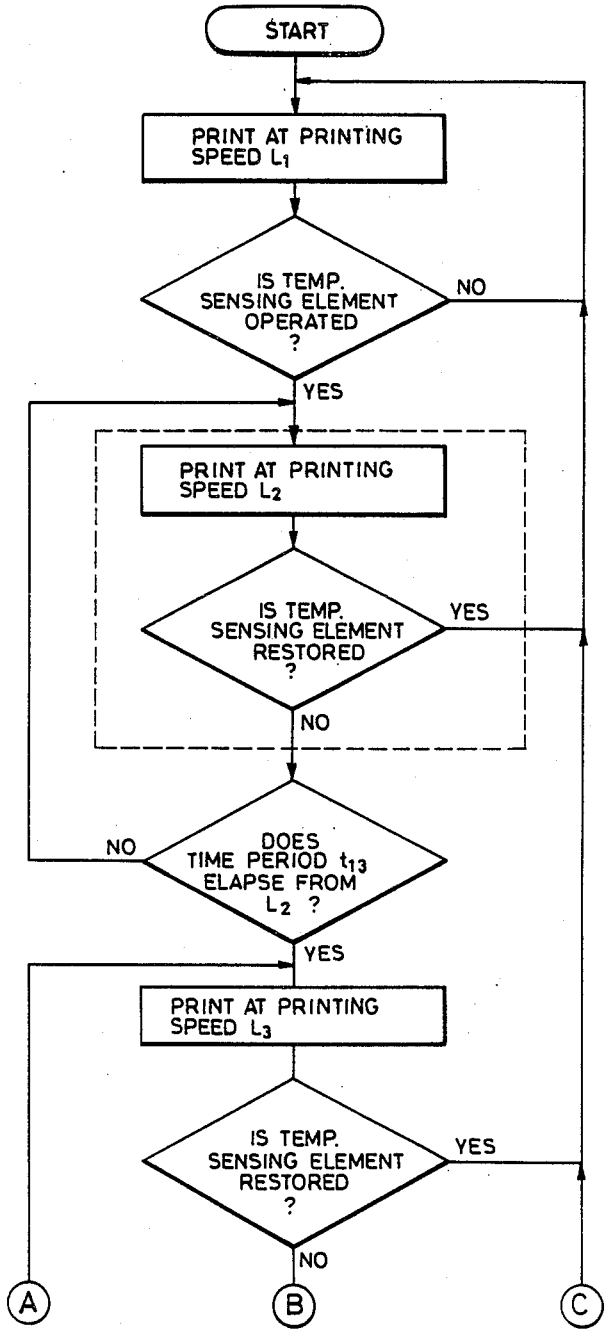
FIGS. 6 and 7 are two parts of a flow chart showing the control operation of a controller in the device of the invention.
Figure 7:
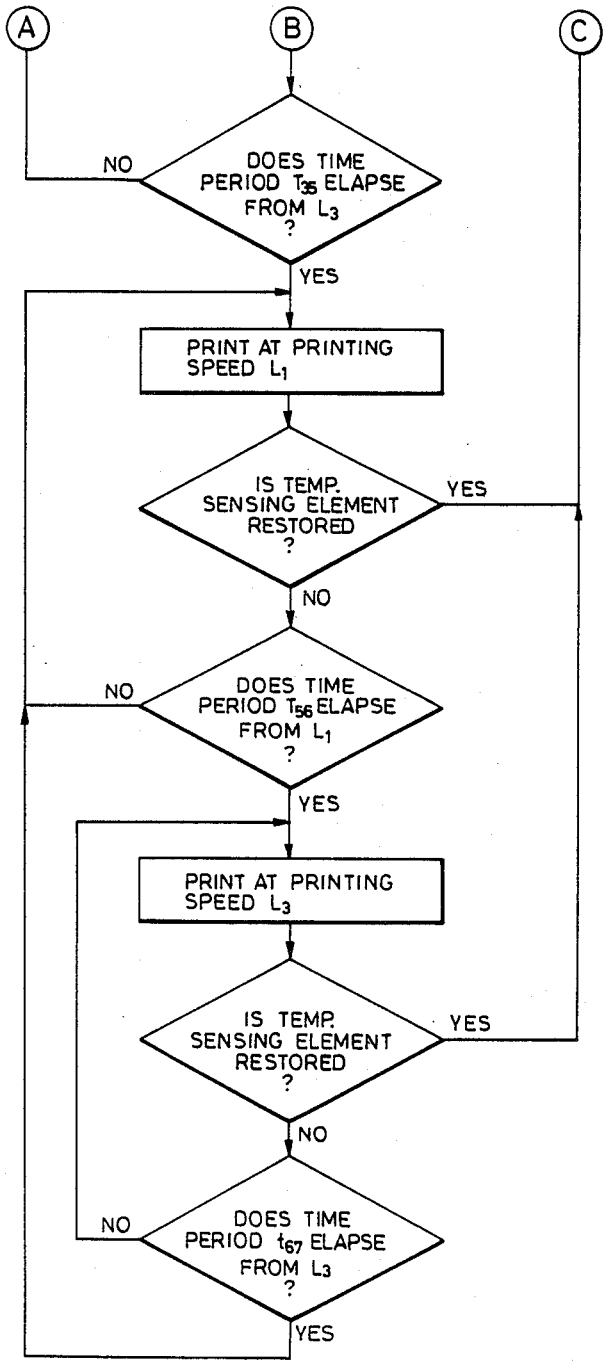

FIGS. 6 and 7 are two parts of a flow chart showing the above-described operation of the controller 8.

The printing speed may be changed to $L_2$ or $L_3$ as follows: In general, a printer repeatedly carries out a printing cycle, including a data transfer cycle for receiving printing data, and a sheet feeding cycle for feeding the printing sheet to the printing position, to achieve the printing operation. Therefore, if a dummy period of time is provided after the sheet feeding cycle and it is suitably changed, then the printing speed can be changed to $L_2$ or $L_3$.

Furthermore, in the case of a shuttle printer as disclosed under U.S. Pat. No. 3,941,051 in which a hammer bank containing a plurality of printing hammers arranged along the printing position is reciprocated along the printing position, the printing speed can be changed as required by printing a dot line selectively with one scan, two scans or three scans.

Figure 8:
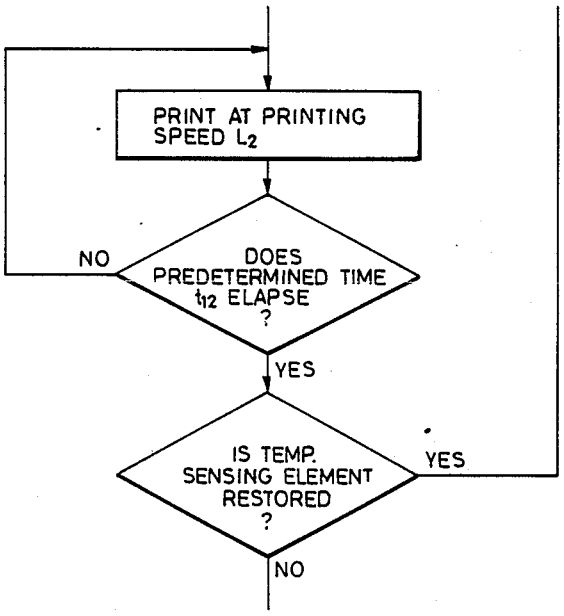
FIG. 8 is a diagram showing a part of a flow chart for another example of the impact printer control device according to the invention.

In the above-described control device, it is detected whether or not the temperature sensing element 7 has been restored immediately after being operated. However, the device may be so modified that it is detected whether or not the temperature sensing element 7 has been restored a predetermined period of time $t_{12}$ ($<t_{13}$) after its operation, so that the printing speed is returned to $L_1$ after the temperature of the electromagnet unit has been sufficiently greatly decreased. That is, even if the temperature sensing element 7 is restored within the period of time $t_{12}$, the printing operation is carried out at the printing speed $L_2$, and therefore the temperature of the electromagnet unit is greatly decreased. When the printing speed is returned to $L_1$, the period of time required for the temperature of the power source unit 6 to reach the operating temperature of the temperature sensing element 7 is increased, and the printing period of time with the printing speed $L_1$ is increased. Thus, the modification is effective in increasing the effective printing speed. A flow chart for the operation of the modification can be obtained by employing FIG. 8 in place of the part of FIG. 6 which is encircled with the broken line.

As is apparent from the above description, a printer high in printing speed, small in size, and low in manufacturing cost can be provided according to the invention. In the printer, the temperature of the electromagnet unit is maintained below the allowable value during operation, and therefore the electromagnet unit is substantially prevented from deterioration. Thus, the printer is highly reliable.

What is claimed is:

1. In an impact printer in which a plurality of printing hammers operable by an electromagnetic unit are arranged linearly, and a printing operation is carried out at a first predetermined printing speed $L_1$ with a printing cycle and a sheet-feeding cycle conducted repeatedly, a control device comprising:

a temperature sensing means positioned to detect the temperature of said electromagnetic unit by one of direct detection and indirect detection, said temperature sensing means having a hysteresis characteristic such that said temperature sensing means produces a signal in response to a first predetermined temperature and is restored at a second predetermined temperature lower than said first predetermined temperature; and a controller means for limiting said printing speed to a second printing speed $L_2$ lower than said first printing speed in response to said signal produced by said temperature sensing means in response to a first predetermined temperature and for returning said printing speed to said printing speed $L_1$ when said temperature sensing means is restored, and for limiting said printing speed to a third printing speed $L_3$ lower than said second printing speed $L_2$ when said temperature sensing means produces said signal for a duration greater than a first predetermined period of time.

2. A control device as claimed in claim 1, in which said temperature sensing means is provided in a power source unit which supplies electric power to a driver adapted to drive said electromagnets.

3. A control device as claimed in claim 1, in which a dummy period of time is provided between said sheet-feeding cycle and said printing cycle to achieve said limits of said printing speed.

4. A control device as claimed in claim 3, including means for setting said second printing speed $L_2$ and said third printing speed $L_3$ with said dummy period of time changed.

5. A control device as claimed in claim 1, in which said first predetermined period of time is the sum of a marginal period of time and a period of time which, when said printing operation is continued at said second printing speed $L_2$ at an ambient temperature, is required for the temperature of said electromagnetic unit to become lower than said second predetermined temperature sensing means.

6. In an impact printer in which a plurality of printing hammers operated by an electromagnetic unit are arranged linearly, and a printing operation is carried out at a first predeermined printing speed $L_1$ with a printing cycle and a sheet-feeding cycle conducted repeatedly, a control device comprising:

a temperature sensing element provided at a position where a temperature of said electromagnetic unit can be detected by one of direct detection and indirect detection, said temperature sensing element having a hysteresis characteristic whereby said temperature sensing element is operated at a first predetermined temperature and is restored at a second predetermined temperature lower than said first predetermined temperature; and a controller means for limiting said printing speed to a second printing speed $L_2$ lower than said first printing speed $L_1$ in response to the operation of said temperature sensing element, for returning said printing speed to said first printing speed $L_1$ when said temperature sensing element is restored, and for limiting said printing speed to a third printing speed $L_3$ lower than said second printing speed $L_2$ when said temperature sensing element is maintained in operation for a duration greater than a first predetermined period of time, and, when said printing operation is continued at said third printing speed $L_3$ for a duration greater than a second predetermined period of time, for alternately permitting a first cycle in which said printing operation is carried out at said first printing speed $L_1$ for a duration equal to a third predetermined period of time and a second cycle in which said printing operation is carried out at said third printing speed $L_3$ for a duration equal to a fourth predetermined period of time.

7. A control device as claimed in claim 6, in which said second predetermined period of time is the sum of a marginal period of time and a period of time which, when said printing operation is continued at said second printing speed $L_2$ of an ambient temperature higher than room temperature, is required for the temperature of said electromagnet unit to become lower than the restoration temperature of said temperature sensing element.

8. A control device as claimed in claim 6, in which said third predetermined period of time is shorter than said fourth predetermined period of time.

9. A control device as claimed in claim 6, including means for setting said third predetermined period of time to a value with which, when said printing operation is continued at said first printing speed, the temperature of said electromagnet unit will not exceed an allowable value.

10. A control device as claimed in claim 6, including means for setting said fourth predetermined period of time to a value with which, when said printing operation is continued at said third printing speed, the temperature of said electromagnet unit is sufficiently decreased.

* * * * *